US005582239A

United States Patent [19]

Tsunoda et al.

[11] Patent Number: 5,582,239

[45] Date of Patent: Dec. 10, 1996

[54] HEAT EXCHANGER AND METHOD OF MAKING SAME

[75] Inventors: Masataka Tsunoda, Isesaki; Tomonari Morita, Sawa-gun, both of Japan

[73] Assignee: Sanden Corporation, Gunma, Japan

[21] Appl. No.: 441,417

[22] Filed: May 15, 1995

[30] Foreign Application Priority Data

May 16, 1994 [JP] Japan ..... 6-124690

[51] Int. Cl.[6] ..... F28F 9/02

[52] U.S. Cl. ..... 165/76; 165/176; 165/DIG. 482; 29/890.052

[58] Field of Search ..... 165/76, 176; 29/890.052

[56] References Cited

U.S. PATENT DOCUMENTS

| | | | |
|---|---|---|---|
| 3,835,920 | 9/1974 | Mondt . | |
| 5,042,578 | 8/1991 | Tanabe | 165/174 |
| 5,097,900 | 3/1992 | Yamaguchi . | |
| 5,297,624 | 3/1994 | Haussmann et al. | 165/173 |
| 5,329,995 | 7/1994 | Dey et al. | 165/153 |
| 5,348,083 | 9/1994 | Hosoya et al. . | |

FOREIGN PATENT DOCUMENTS

| | | | |
|---|---|---|---|
| 59-229195 | 12/1984 | Japan | 165/176 |
| 4225796 | 8/1992 | Japan | 165/176 |

*Primary Examiner*—Allen J. Flanigan
*Attorney, Agent, or Firm*—Baker & Botts, L.L.P.

[57] ABSTRACT

A heat exchanger comprises a first tank and a second tank spaced vertically from the first tank. The first tank includes a first partition disposed therein to divide the first tank into a first number of chambers, wherein the first number of chambers is at least two and has respectively an inlet to allow the heat transfer medium to enter the heat exchanger and an outlet to allow the heat transfer medium to exit the heat exchanger. The second tank includes a second partition disposed therein to divide the second tank into a second number of chambers, wherein the second number of chambers is preferably one less than the first number of chambers. The first tank and the second tank respectively include a concave surface horizontally formed on walls of the tanks, wherein one end of each of the first and second partitions respectively insert into each of the concave surfaces for preventing overturn of the partitions during assembly of the tanks. In this manner, the partition plates do not fall down during the assembly process of the tanks. Further, the partition plates do not incline and move from a predetermined place during the process.

14 Claims, 8 Drawing Sheets

HEAT EXCHANGER AND METHOD OF MAKING SAME

BACKGROUND OF THE INVENTION

1. Field of the Invention

This invention relates to a heat exchanger and method for making a heat exchanger for use in an air conditioning system for vehicles, and more particularly, to a heat exchanger that allows for efficient and easy assembly.

2. Description of the Background Art

FIGS. 1 and 2 show a conventional heat exchanger used in an air conditioning system, for example, an evaporator or a condenser. In FIGS. 1 and 2, a heat exchanger comprises an upper tank 105, a lower tank 110 and heat exchanger core 115 disposed between the upper tank and the lower tank. The heat exchanger core 115 comprises a plurality of heat transfer tubes disposed parallel to one another. The upper tank 105 has an upper wall and a lower wall, which are connected to each other. The upper tank 105 is divided into three chambers by first partition plate 151 and second partition plate 152. First partition plate 151 and second partition plate 152 include respectively notched portions formed in the centers thereof. First partition plate 151 includes a plurality of holes therethrough. Lower tank 110 is divided into two chambers, such as first lower chamber and a second lower chamber, by partition plate 153. Further, the lower tank includes preventing overturn plate 154 therein. Preventing overturn plate 154 includes a notched portion formed in the center thereof and a plurality of holes therein. The number of holes formed in preventing overturn plate 154 as well as their respective diameter is determined so that a heat exchanger medium may pass freely through the holes. The lower wall of the upper tank 105 and the upper wall of the lower tank 110 are provided with a plurality of connection holes, respectively, for interconnecting a plurality of heat transfer tubes therebetween. An inlet pipe 210 and outlet pipe 220 are connected to the upper tank 105.

In assembling the upper tank 105 and the lower tank 110, first partition plate 151 is placed on the lower wall of the upper tank 105 so as to be located in the center of the lower wall of the upper tank 105 and second partition plate 152 is connected with first partition plate 151 at right angles to each other, so that the notched portion of second partition plate 152 fixedly inserts into the center notched portion of first partition plate 151 in an attempt to prevent movement and overturning during brazing. Further, in assembling the lower tank 110, partition plate 153 is placed on the lower wall of the lower tank 110 so as to be located in the center of the lower wall of the lower tank 110. In addition, preventing overturn plate 154 is connected with partition plate 153 at a right angle, so that the notched portion of partition plate 153 fixedly inserts into the center notched portion of the preventing overturn plate 154 to prevent movement and overturning during brazing. Finally, the heat exchanger may be placed in a brazing furnace, so that all of its parts may be brazed together.

In the arrangement described above, the partition plates 151 and 153 tend to fall down until they are connected with their corresponding partition plate 152 or the preventing overturn plate 154 respectively. Further, the partition plates 151, 152 and 153 and the preventing overturn plate 154 tend to incline and move from the desired location unless these parts are formed to extremely precise sizes.

In addition to the above problems, in prior art heat exchangers where partition plates and preventing overturn plates are not formed within very accurate size constraints, the partition plates and the preventing overturn plate often fail to connect with the upper tank 105 and the lower tank 110 during brazing because there exists a gap between the partition plates or preventing overturn plate and the walls of the upper tank 105 and the lower tank 110.

As a result of these problems, the brazing step of the assembly process is both complicated and time consuming. These factors cause a reduction in the overall operational productivity of the assembly process.

SUMMARY OF THE INVENTION

It is thus an object of the present invention to provide a heat exchanger wherein the assembly is accomplished by a simple and efficient process.

To achieve this and other objects in one preferred embodiment, a heat exchanger according to this invention comprises a first tank with a second tank spaced vertically from the first tank. Each of the first and second tanks include a plurality of connection holes aligned in rows. The first tank includes first and second partitions disposed therein to divide the first tank into a first number of chambers, wherein the first number of chambers is at least two and has respectively an inlet to allow the heat transfer medium to enter the heat exchanger and an outlet to allow the heat transfer medium to exit the heat exchanger. The second tank includes a third partition disposed therein to divide the second tank into a second number of chambers, wherein the second number of chambers is preferably one less than the first number of chambers. A plurality of heat transfer tubes are fixedly disposed between the first tank and the second tank in fluid communication. The first tank and the second tank respectively include concave portions horizontally formed on walls of the tanks, wherein ends of each of the first and second partitions respectively insert into each of the concave portions for preventing overturn of the partitions during assembly of the tanks.

A heat exchanger according to the present invention may be constructed by one of the following preferred methods. For example, the method of manufacturing a heat exchanger according to one preferred embodiment of the invention includes bending a plurality of planer raw plates to have U-shaped cross sections defining a flat portion as an upper wall and a bottom wall of the first and second tanks. Next, a plurality of connection holes are formed on the flat portion of the bottom wall of the first tank and the upper wall of the second tank. Concave portions are then formed on the flat portion of the upper wall and the bottom wall of the first tank, after which one end of the first partition is inserted into the concave portion of the bottom wall of the first tank and one end of the second partition is inserted into the concave portion of the bottom wall of the first tank so that the second partition is substantially perpendicular to the first partition. Next, the upper wall of the first tank is placed on the bottom wall of the first tank so that a circumference of the upper wall is overlapped with the circumference of the bottom wall of the first tank, and other ends of the first partition and the second partition insert into the concave portions of the upper wall and the bottom wall of the first tank. One end of the third partition is then inserted into the concave portion of the bottom wall of the second tank, and the upper wall of the second tank is placed on the bottom wall of the second tank so that a circumference of the upper wall meets with a circumference of the bottom wall of the second tank. The other end of the third partition is next inserted into the concave portions of the upper wall and the bottom wall of the lower tank. Finally, the opposite end of the heat transfer tubes are inserted into the respective connection holes of the first tank and the second tank.

In the heat exchanger according to the preferred embodiment, the partition plates remain in place during the assembly process. Further, these partition plates do not incline and/or move from a predetermined place even if the size of the parts, such as partition plates or walls of the tanks varies to some degree. In this way, partition plates are fixedly and securely connected with the tanks by brazing because there are no gaps between these partition plates and the walls of the tanks. Further, the concave surfaces which are formed function to prevent the tanks from being deformed by pressure during operation. Further objects, features, and other aspects of this invention will be understood from the following detailed description of the preferred embodiments of this invention referring to the annexed drawings.

DETAILED DESCRIPTION OF THE DRAWINGS

Figure 1:
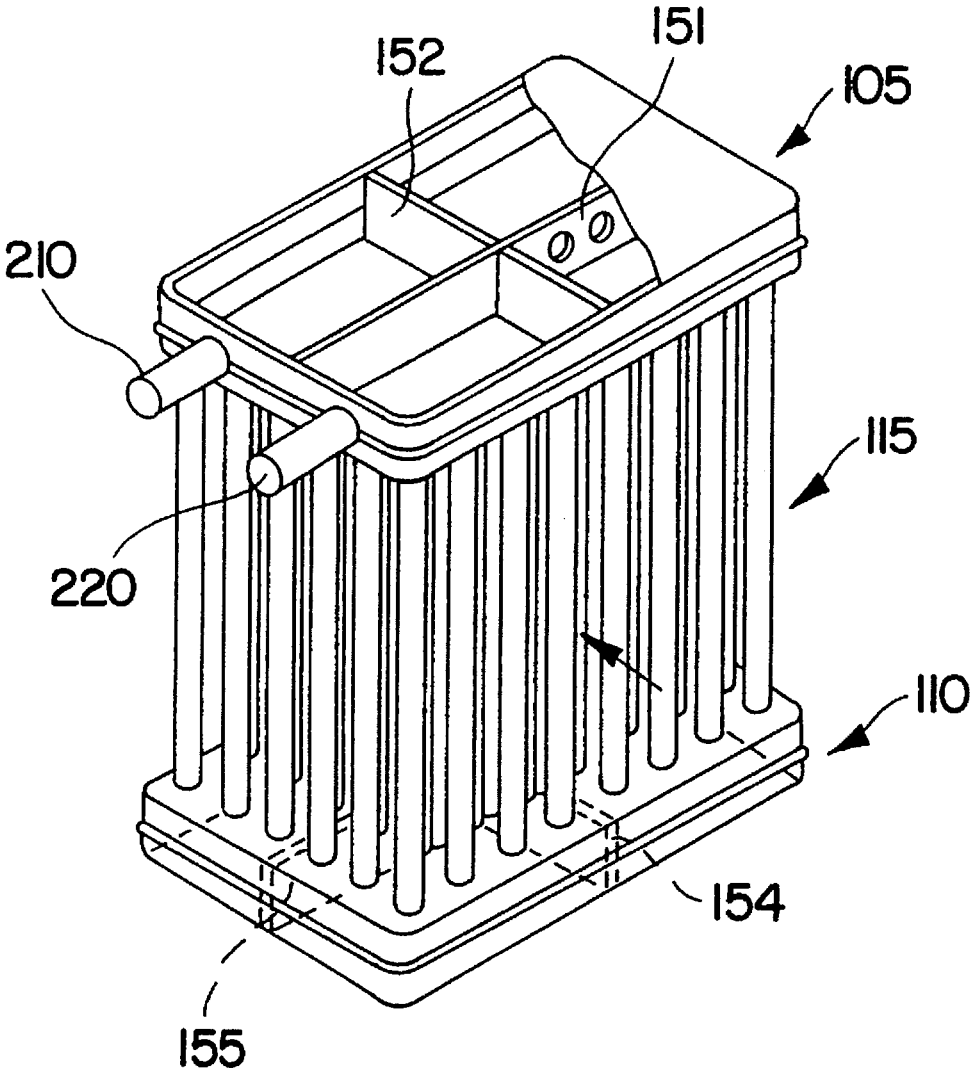
FIG. 1 (PRIOR ART)
FIG. 1 is a perspective view of a prior art heat exchanger.
Figure 2:
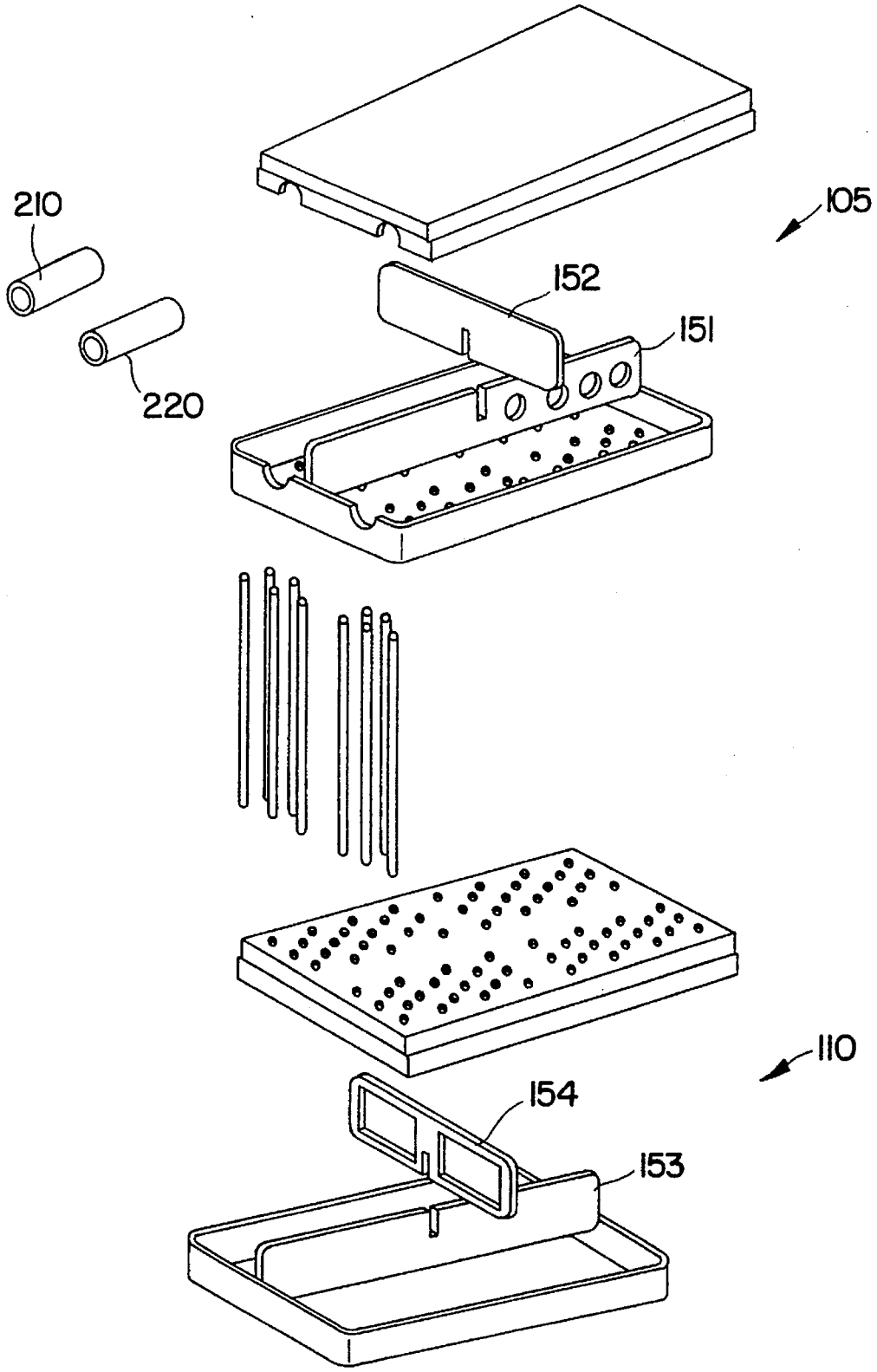
FIG. 2 (PRIOR ART)
FIG. 2 is an exploded view of the heat exchanger illustrated in FIG. 1.
Figure 3:
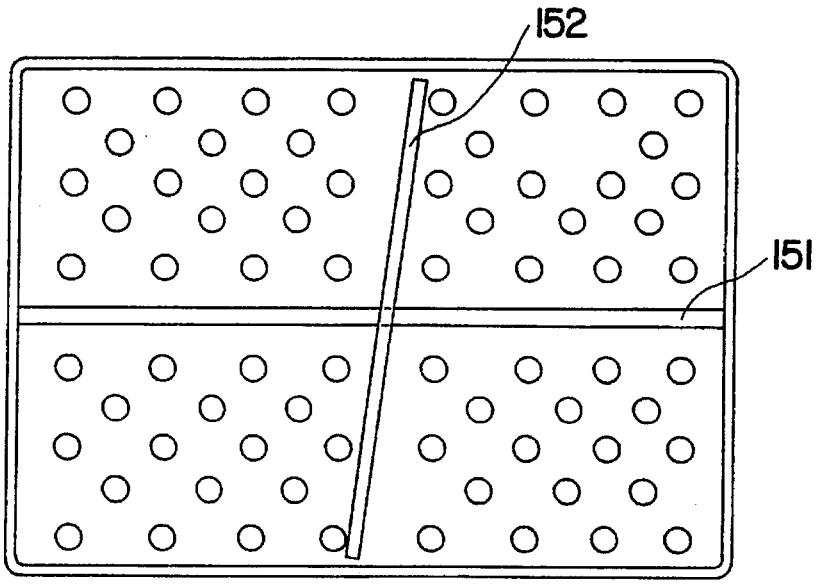
FIG. 3 is a plan view of the bottom wall of the top tank in the heat exchanger illustrated in FIG. 1.
Figure 4:
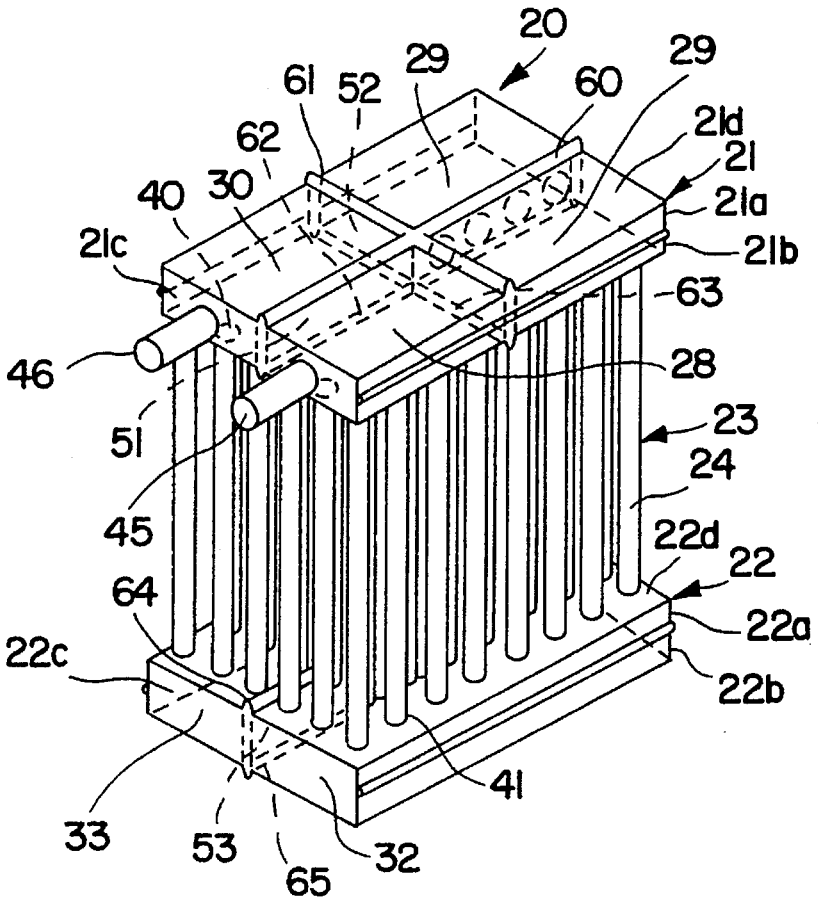
FIG. 4 is a perspective view of a heat exchanger in accordance with a first embodiment of the present invention.
Figure 5:
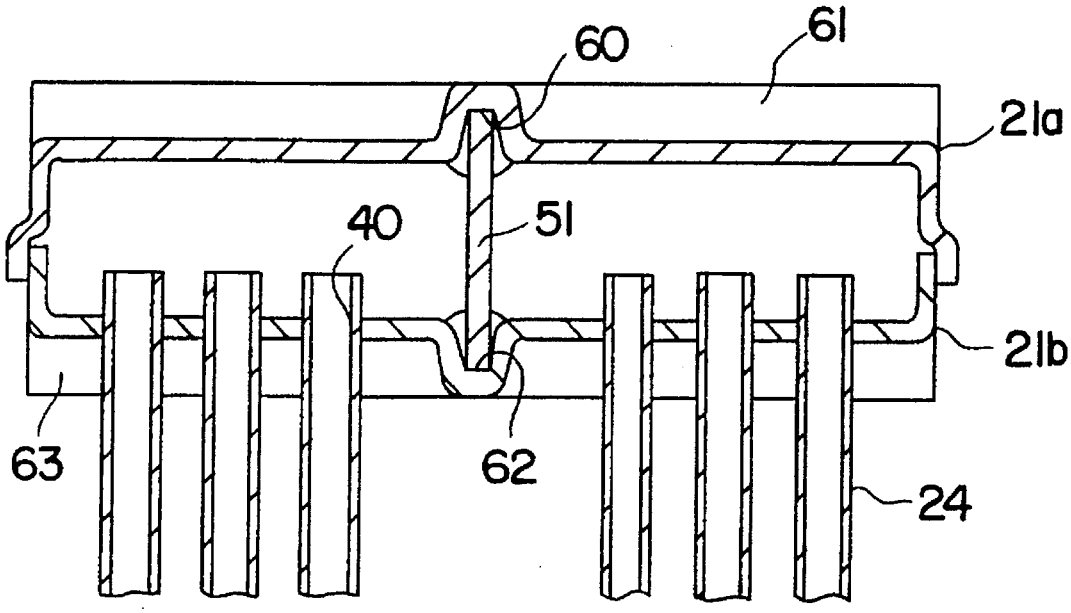
FIG. 5 is an enlarged sectional view of the heat exchanger illustrated in FIG. 4.

A heat exchanger in accordance with a first embodiment of the present invention is illustrated in FIGS. 4 and 5.

In FIGS. 4 and 5, heat exchanger 20 comprises upper tank 21, lower tank 22 vertically spaced from upper tank 21 and heat exchanger core 23 disposed between upper tank 21 and lower tank 22. Heat exchanger core 23 comprise a plurality of heat transfer tubes 24 spaced from one another and disposed in parallel to one another. Upper tank 21 includes upper wall 21*a* and bottom wall 21*b*, which are connected so as to form an enclosed tank. Upper wall 21*a* of upper tank 21 includes first concave surface 60 and second concave surface 61 formed inside of upper tank 21 and extending from one horizontal end to other horizontal end. First concave surface 60 and second concave surface 61 are formed to be U-shaped in cross section and are vertically projected toward the outside of upper tank 21. Further, first concave surface 60 and second concave surface 61 are formed to intersect each other and to be substantially perpendicular to each other so as to divide upper wall 21*a* into four areas.

Bottom wall 21*b* of upper tank 21 includes third concave surface 62 and fourth concave surface 63 formed inside of upper tank 21. Third concave surface 62 and fourth concave surface 63 are formed to be U-shaped in cross section and are vertically projected toward the outside of upper tank 21. Further, third concave surface 62 and fourth concave surface 63 are formed to intersect each other and to be substantially perpendicular to each other so as to divide bottom wall 21*b* into four areas.

Upper wall 22*a* of lower tank 22 includes concave surface 64 formed inside of lower tank 22. Bottom wall 22*b* of lower tank 22 includes concave surface 65 formed inside of lower tank 22. Concave surfaces 64 and 65 are formed to be U-shaped in cross section and are vertically projected toward the outside of lower tank 22. Further, concave surfaces 64 and 65 respectively divide upper wall 21*a* and bottom wall 22*b* into two areas. Further, upper tank 21 includes end plates 21*c* and 21*d* respectively covering both ends of the cylindrical opening which are united with upper wall 21*a* and bottom wall 21*b*. Bottom wall 21*b* of upper tank 21 and upper wall 22*a* of lower tank 22 are provided with a plurality of connection holes 40 and 41, respectively, for interconnecting a plurality of heat transfer tubes 24 therebetween. Upper tank 21 is divided into three chambers, such as first upper chamber 28, second upper chamber 29 and third upper chamber 30 by first partition plate 51 and second partition plate 52. Lower tank 22 is divided into two chambers such as first lower chamber 32 and second lower chamber 33, by partition plate 53 which is inserted into concave surfaces 64 and 65. Inlet pipe 45 and outlet pipe 46 are connected to upper tank 21.

Figure 6:
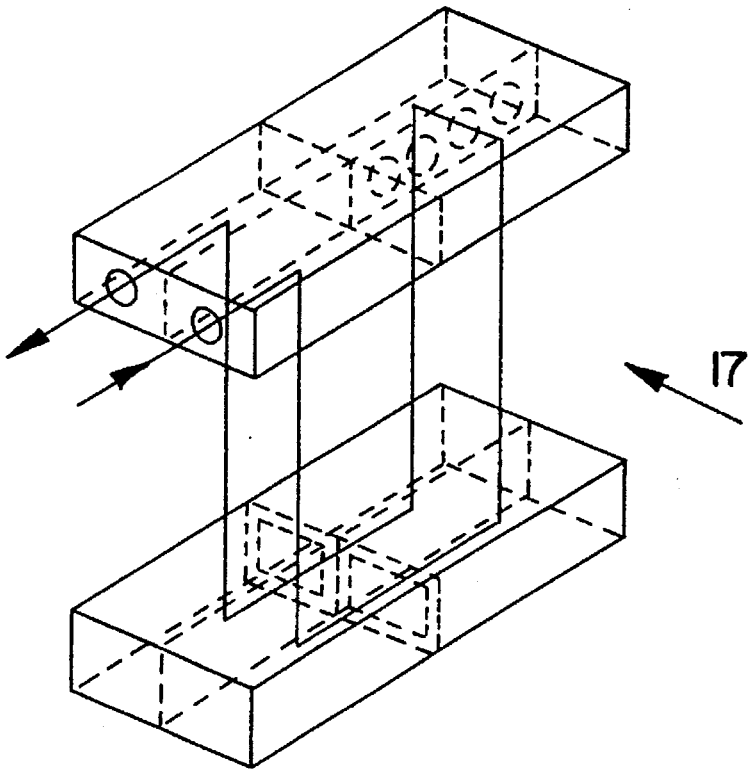
FIG. 6 is a schematic perspective view of a heat exchanger, showing an example of a heat exchanger medium flow path.

Referring to FIG. 6 as well as FIGS. 4 and 5 a heat exchanger medium may be introduced via inlet pipe 45 into first upper chamber 28 and may flow down through heat transfer tubes 24 until it reaches first lower chamber 32 of lower tank 22. The medium then may flow back into second upper chamber 29 through heat transfer tubes 24. Further, the heat exchanger medium may then flow from second upper chamber 29 of upper tank 21 through heat transfer tubes 24 into second lower chamber 33 of lower tank 22 and then back to third upper chamber 30 through heat transfer tubes 24. When the heat exchanger medium flows through heat transfer tubes 24, heat is exchanged between the heat exchanger medium and the air flow 17 passing across heat transfer tubes 24.

Figure 7:
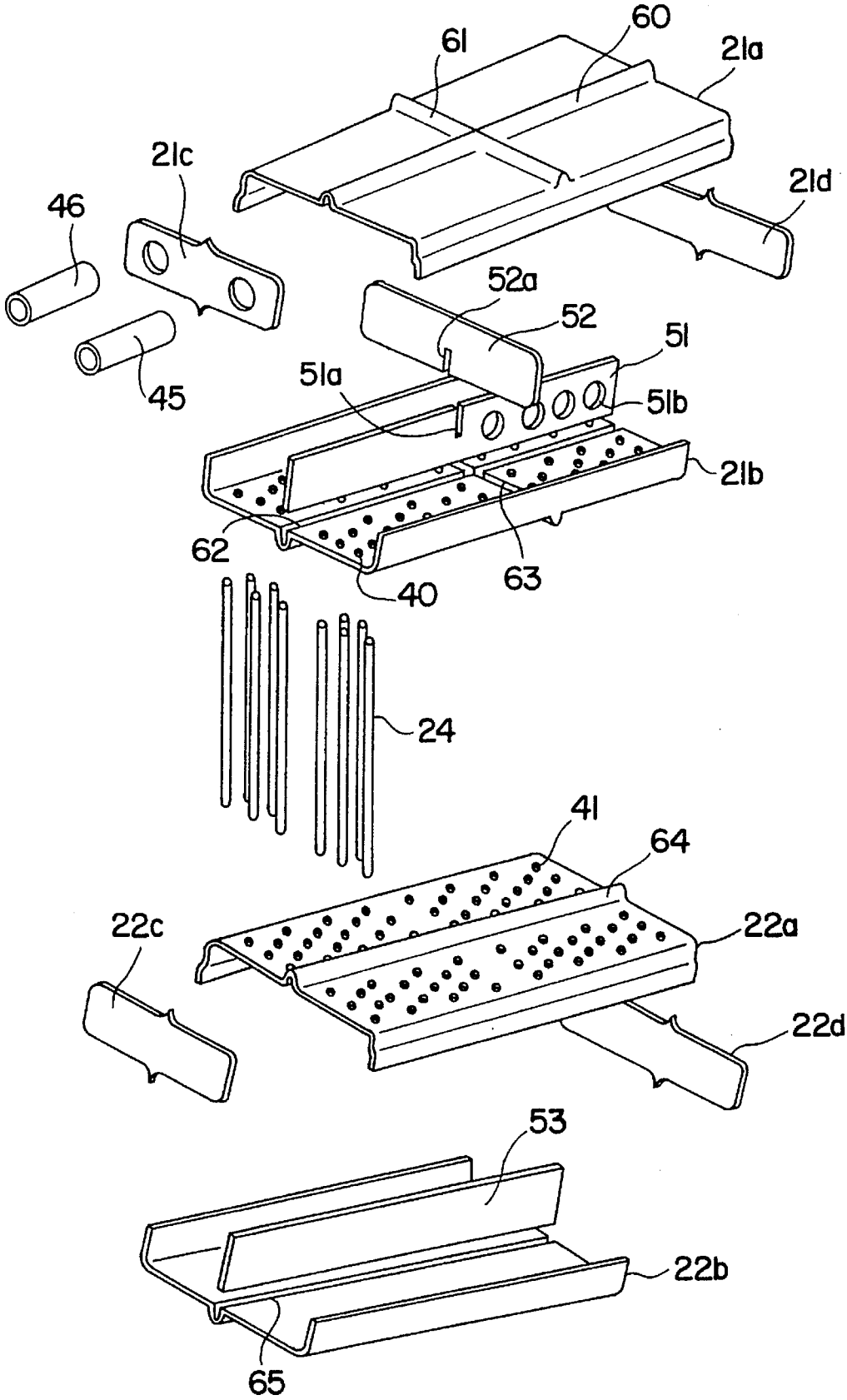
FIG. 7 is an exploded view of the heat exchange unit illustrated in FIG. 4.

In a method of assembling upper tank 21 and lower tank 22, referring to FIG. 7, first partition plate 51 includes notched portion 51*a* formed in the center thereof and a plurality of holes 51*b* therein. The plurality of holes 51*b* are formed with a predetermined number, pitch, and diameter, so that a heat exchanger medium may pass freely through holes 51*b* of first partition plate 51. Upper wall 21*a* and bottom wall 21*b* are formed to be U-shaped in cross section. Concave surfaces 60, 61, 62 and 63 may be formed by a press work. One long end of first partition 51 is inserted into third concave surface 62 of bottom wall 21*b* of upper tank 21 so as to be positioned in the center of upper tank 21. Second partition plate 52 is connected with first partition plate 51 at a right angle so the notched portion 52*a* of second partition plate 52 fixedly inserts into center notched portion 51*a* of first partition plate 51. Thereafter, upper wall 21*a* is placed on bottom wall 21*b* so that the other ends of partition plate 51 and 52 are respectively inserted into first concave surface 60 and second concave surface 61. Further, first end plate 21*c* and second end plate 21*d* are forcibly inserted into the openings which are formed by upper wall 21*a* and bottom wall 21*b*.

In assembling lower tank 22, one long end of partition plate 53 is inserted into concave surface 65 of bottom wall 22*b* of lower tank 22 so as to be positioned in the center of lower tank 22. Thereafter, upper wall 22*a* is placed on bottom wall 22*b* so that other end of partition plate 53 is inserted into concave surface 64. Further, first end plate 22*c* and second end plate 22*d* are forcibly inserted into the openings which are formed by upper wall 22*a* and bottom wall 22*b*.

Additionally, both ends of heat transfer tubes 24 are connected with upper tank 21 and lower tank 22 through connection holes 40 of bottom wall 21*b* and connection holes 41 of upper wall 22*a*. Finally, assembled heat exchanger 10 may be placed in a brazing furnace, so that all of its parts may be simultaneously brazed together.

In the arrangement described above, first partition plate 51, second partition plate 52 of upper tank 21, and partition plate 53 of lower tank 53 do not fall down during the assembly process of the tanks. Further, these partition plates do not incline or move from a predetermined place even if the size of the parts, such as partition plates 51, 52, and 53, wall of upper tank 21 and lower tank 22 are not perfectly accurate. Thereby, partition plates 51, 52, and 53 are fixedly and securely connected with upper tank 21 and lower tank 22 by brazing because there is no gap between these partition plates and walls of upper tank 21 and lower tank 22. Further, the concave surfaces have a function which prevents the tanks from being deformed by pressure during operation or brazing. As a result, the heat exchanger of the present invention can be manufactured using a simple process and at a low cost in comparison with the prior art.

Figure 8:
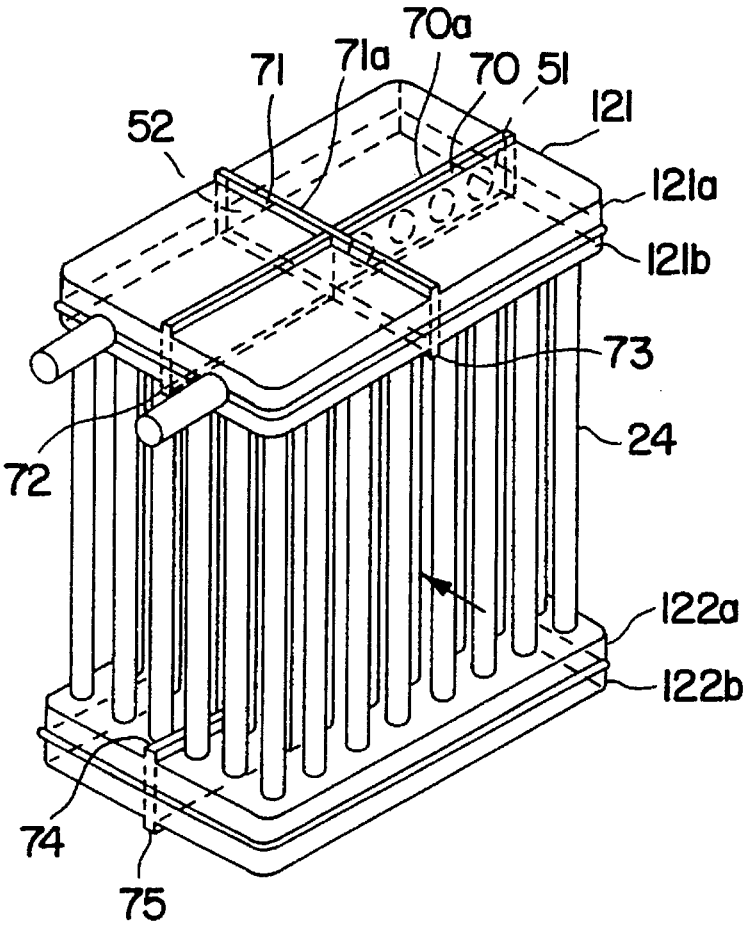
FIG. 8 is a perspective view of a heat exchanger in accordance with a second embodiment of the present invention.
Figure 9:
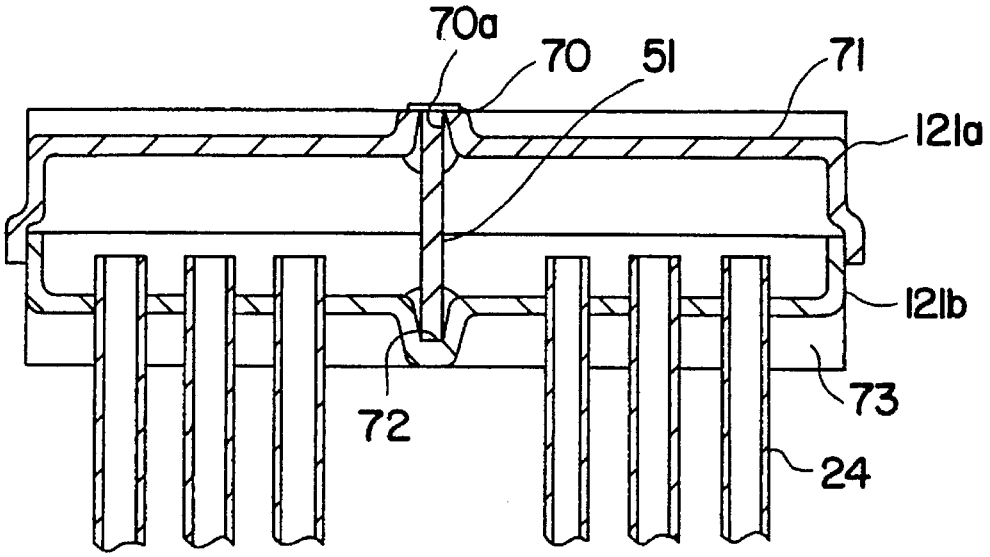
FIG. 9 is an enlarged sectional view of the heat exchanger illustrated in FIG. 8.

FIGS. 8 and 9 illustrate a second embodiment of the present invention. In this embodiment, upper wall 121*a* of upper tank 121 includes a first concave surface 70 and a second concave surface 71 formed inside of upper tank 121. The concave surfaces in this embodiment are formed in a box shape. First concave surface 70 and second concave surface 71 project toward the outside of upper tank 121 and are formed to be substantially perpendicular to each other so as to divide upper wall 121*a* into four areas. Further, first concave surface 70 and second concave surface 71 include openings 70*a* and 71*a* respectively, formed outside of upper tank 121 by cutting out the top ends of concaves 70 and 71.

Figure 10:
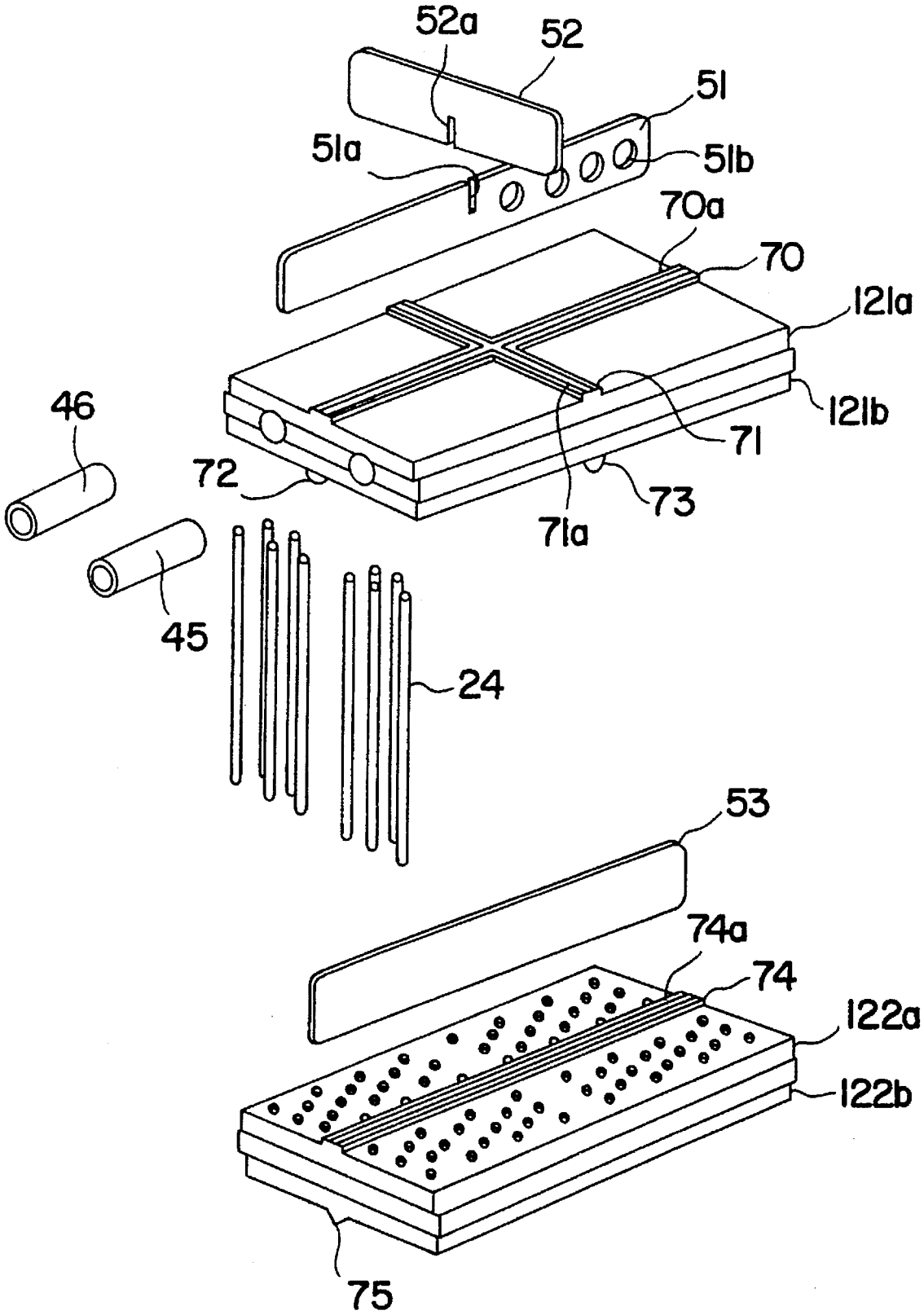
FIG. 10 is an exploded view of the heat exchange unit illustrated in FIG. 8.

FIG. 10 illustrates a method for forming a heat exchanger according to the second embodiment of this invention. Upper wall 121*a* is placed on bottom wall 121*b* so that they overlap. Then partition plate 51 is inserted into the inside of upper tank 121 through opening 70*a*. One long end of partition plate 51 may then be further inserted into concave 72. Second partition plate 52 may be inserted into upper tank 121 through opening 71*a* and connected with first partition plate 51 at right angles to each other, so that notched portion 52*a* of second partition plate 52 fixedly inserts into center notched portion 51*a* of first partition plate 51. One long end of partition plate 52 may be further inserted into concave 73 to prevent the movement thereof during brazing. Finally, partition plate 53 may be inserted into lower tank 122 through opening 74*a*. Partition plate is then further inserted into concave 75. In such a structure, substantially the same advantages as those in the first embodiment can be obtained.

Figure 11:
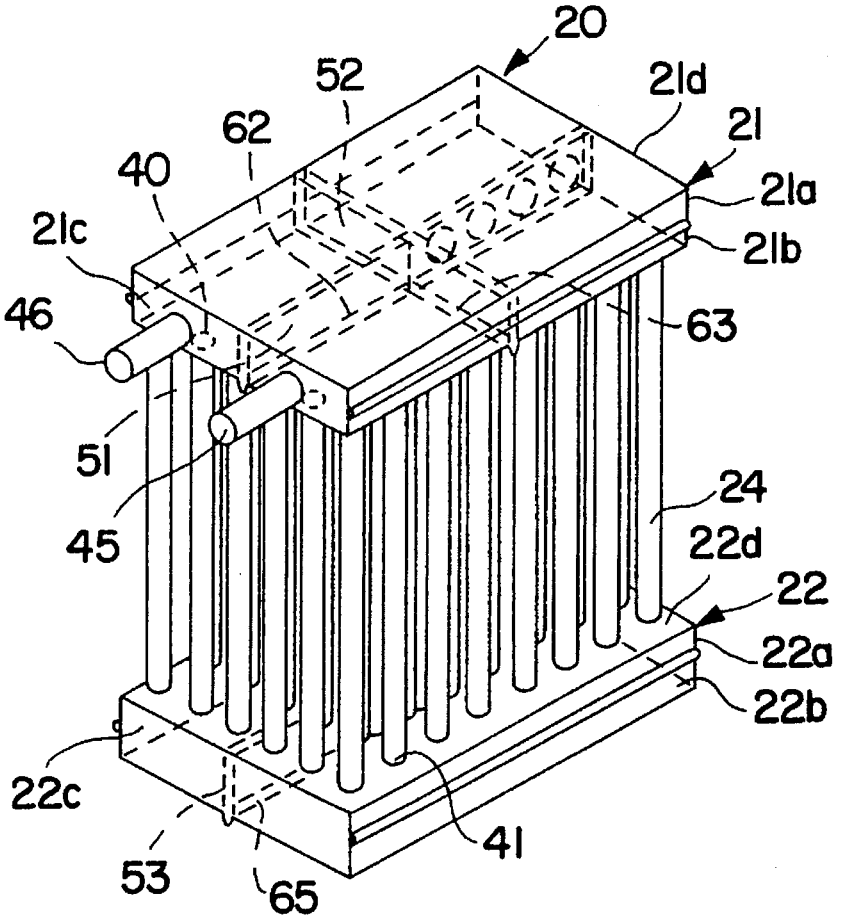
FIG. 11 is a perspective view of a heat exchanger in accordance with a third embodiment of the present invention.
Figure 12:
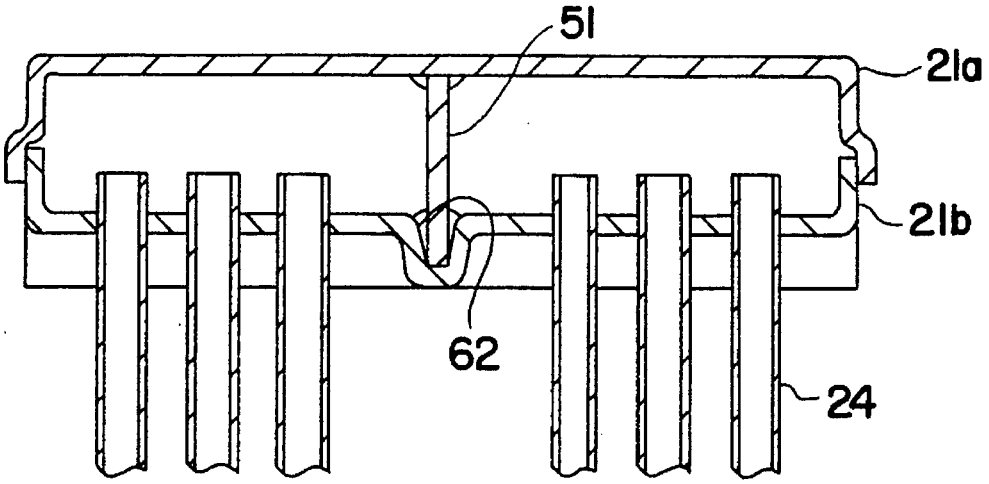
FIG. 12 is an enlarged sectional view of a heat exchanger illustrated in FIG. 11.

FIGS. 11 and 12 illustrate a third embodiment of the present invention. In this embodiment, upper wall 21*a* of upper tank 21 does not include a concave surface inside of upper tank 21. However, bottom wall 21*b* of upper tank 21 includes a first concave surface 62 and second concave surface 63 vertically projecting toward the outside of upper tank 21 and formed to intersect and be substantially perpendicular to each other so as to divide bottom wall 21*b* into four areas. Further, upper wall 22*a* of lower tank 22 does not include a concave surface. Bottom wall 22*b* of lower tank 22 includes concave surface 65 formed inside of lower tank 22. Concave surface 65 is formed to be U-shaped in cross section and vertically projects toward the outside of lower tank 22. Further, concave surface 65 divides bottom wall 22*b* of lower tank 22 into two areas.

In such a structure, substantially the same advantages as those in the first and second embodiments can be obtained. Moreover, in this embodiment, the forming process of a concave can be simplified because upper wall 21*a* of upper tank 21 and upper wall 22*a* of lower tank 22 does not include a concave surface.

This invention has been described in connection with the preferred embodiments. These embodiments, however, are merely exemplary and the invention is not restricted thereto. It will be easily understood by those skilled in the art that variations can be easily made within the scope of this invention as defined by the claims.

We claim:

1. A heat exchanger comprising:

a first substantially rectangular tank including a plurality of connection holes, a first partition and a second partition disposed therein to divide said first tank into a first number of chambers, said first tank respectively including an inlet to allow a heat transfer medium to enter said heat exchanger and an outlet to allow a heat transfer medium to exit said heat exchanger;

a second substantially rectangular tank spaced vertically from said first tank and including a plurality of connection holes, and a third partition disposed therein to divide said second tank into a second number of chambers;

a plurality of heat transfer tubes fixedly disposed between said first tank and said second tank in fluid communication; and said first tank including U-shaped concave portions horizontally formed on an upper wall and a bottom wall of said first tank and said second tank, wherein ends of said first partition and said second partition respectively insert into said U-shaped concave portions for preventing overturn of said first partition and said second partition during assembly of said first tank, said second tank including U-shaped concave portions horizontally formed on an upper wall and a bottom wall thereof, wherein ends of said third partition insert into said U-shaped concave portions for preventing overturn of said third partition during assembly of said second tank.

2. The heat exchanger of claim 1, wherein said second number of chambers is one less than said first number of chambers.

3. The heat exchanger of claim 1, wherein said plurality of connection holes are aligned in rows.

4. The heat exchanger of claim 1, wherein said U-shaped concave portions of said first tank are substantially perpendicular to one another.

5. The heat exchanger of claim 1, wherein said concave portions of said first tank and said second tank comprise open slots formed in the walls of said tanks.

6. A method of manufacturing a heat exchanger, said heat exchanger including:

a first tank including a plurality of connection holes, a first partition and a second partition disposed therein to divide said first tank into a first number of chambers, said first tank including an inlet to allow a heat transfer medium to enter said heat exchanger and an outlet to allow a heat transfer medium to exit said heat exchanger;

a second tank spaced vertically from said first tank, including a plurality of connection holes and a third partition disposed therein to divide said second tank into a second number of chambers;

a plurality of heat transfer tubes fixedly disposed between said first tank and said second tank in fluid communication, said first tank including U-shaped concave portions horizontally formed on an upper wall and a bottom wall of said first tank and said second tank, wherein ends of said first partition and said second partition respectively insert into said U-shaped concave portions for preventing overturn of said first partition and said second partition during assembly of said first tank, said second tank including U-shaped concave portions horizontally formed on an upper wall and a bottom wall thereof, wherein ends of said third partition insert into said U-shaped concave portions for preventing overturn of said second tank comprising the steps of:

bending a plurality of planer raw plates to have U-shaped cross sections defining a flat portion and flange portions extending from both ends of said flat portion as an upper wall and a bottom wall of said first tank and said second tank;

opening a plurality of connection holes on said flat portion of said bottom wall of said first tank and said upper wall of said second tank;

forming U-shaped concave portions on said flat portion of said upper wall and said bottom wall of said first tank;

inserting an end of said first partition into one said U-shaped concave portion of said bottom wall of said first tank and inserting one end of said second partition into one said U-shaped concave portion of said bottom wall of said first tank so that said second partition is substantially perpendicular to said first partition;

placing said upper wall of said first tank on said bottom wall of said first tank so that the said upper wall is overlapped with said bottom wall of said first tank, and another end of said first partition and said second partition insert into said U-shaped concave portions of said upper wall and said bottom wall of said first tank;

inserting one end of said third partition into said U-shaped concave portion of said bottom wall of said second tank;

placing said upper wall of said second tank on said bottom wall of said second tank so that said upper wall is overlapped with said bottom wall of said second tank, and another end of said third partition inserts into said U-shaped concave portions of said upper wall and said bottom wall of said lower tank; and inserting opposite ends of said heat transfer tubes into said respective connection holes of said first tank and said second tank.

7. The method of claim 6 wherein said second number of chambers is one less than said first number of chambers.

8. A method of manufacturing a heat exchanger, said heat exchanger including:

a first tank including a plurality of connection holes, a first partition and a second partition disposed therein to divide said first tank into a first number of chambers, said first tank including an inlet to allow a heat transfer medium to enter said heat exchanger and an outlet to allow a heat transfer medium to exist said heat exchanger;

a second tank spaced vertically from said first tank and including a plurality of connection holes, and a third partition disposed therein to divide said second tank into a second number of chambers;

a plurality of heat transfer robes fixedly disposed between said first tank and said second tank in fluid communication, said first tank including U-shaped concave portions horizontally formed on an upper wall and a bottom wall and opened to an outside thereof, wherein ends of said first partition and said second partition respectively insert into said U-shaped concave portions for preventing overturn of said first partition and said second partition during assembly, said second tank including U-shaped concave portions horizontally formed on an upper wall and a bottom wall and opened to an outside thereof, wherein ends of said third partition insert into said U-shaped concave portions for preventing overturn of said third partition during assembly comprising the steps of:

bending a plurality of planar raw plates to have an U-shaped cross section defining a flat portion and flange portions extending from both ends of said flat portion as an upper wall and a bottom wall of said first tank and said second tank;

opening a plurality of connection holes in said flat portion of said bottom wall of said first tank and said upper wall of said second tank;

forming U-shaped concave portions in said flat portion of said upper wall and said bottom wall of said first tank;

forming openings on top of said U-shaped concave portion;

placing said upper wall of said first tank on said bottom wall of said first tank so that said upper wall is overlapped with said bottom wall of said first tank;

inserting an end of said first partition into said U-shaped concave portion of said bottom wall of said first tank through said opening;

inserting a second partition into said U-shaped concave of said bottom wall through said opening so that second partition is substantially perpendicular to said first partition;

forming U-shaped concave portions on said flat portion of said upper wall and said bottom wall of said second tank;

forming openings on top of said U-shaped concave portion;

placing said upper wall of said second tank on said bottom wall of said second tank so that said upper wall is overlapped with said bottom wall of said second tank;

inserting an end of said third partition into said U-shaped concave portion of said bottom wall of said second tank through said opening; and inserting ends of said heat transfer tubes into said respective connection holes of said first tank and said second tank.

9. A heat exchanger manufactured by the method of claim 6.

10. A heat exchanger manufactured by the method of claim 8.

11. A heat exchanger comprising:

a first substantially rectangular tank and at least one partition disposed therein, said partition dividing said first tank into a plurality of chambers;

a second substantially rectangular tank and at least one partition disposed therein, said partition dividing said second tank into a plurality of chambers;

said first tank including at least one U-shaped cross-sectional concave portion when said first tank is viewed in profile along said at least one partition supported by said U-shaped cross-sectional concave portion, each of said at least one U-shaped concave portions individually supporting said at least one partition disposed in said first tank; and said second tank including at least one U-shaped cross-sectional concave portion when said first tank is viewed in profile along said at least one partition supported by said U-shaped cross-sectional concave portion, each of said at least one U-shaped concave portions individually supporting said at least one partition disposed in said second tank.

12. The heat exchanger of claim 11 wherein said first tank and said second tank each include a plurality of connection holes and wherein a plurality of heat transfer tubes are fixedly disposed between said first tank and said second tank in fluid communication.

13. The heat exchanger of claim 11 wherein said first tank includes two U-shaped concave portions and wherein said second tank includes two U-shaped concave portions.

14. A heat exchanger comprising:

a first tank and at least one partition disposed therein, said partition dividing said first tank into a plurality of chambers;

a second tank and at least one partition disposed therein, said partition dividing said second tank into a plurality of chambers;

said first tank including at least one U-shaped concave portion, each of said at least one U-shaped concave portions individually supporting said at least one partition disposed in said first tank;

said second tank including at least one U-shaped concave portion, each of said at least one U-shaped concave portions individually supporting said at least one partition disposed in said second tank; and wherein said U-shaped concave portions disposed in said first tank are substantially perpendicular to one another and wherein said U-shaped concave portions disposed in said second tank are substantially perpendicular to one another.

* * * * *